US005725358A

United States Patent [19]

Bert et al.

[11] Patent Number: 5,725,358

[45] Date of Patent: Mar. 10, 1998

[54] PRESSURE REGULATED ELECTRIC PUMP

[75] Inventors: Jeffrey D. Bert, Richmond, Va.; Christopher L. Strong, Boulder, Colo.

[73] Assignee: Binks Manufacturing Company, Franklin Park, Ill.

[21] Appl. No.: 521,472

[22] Filed: Aug. 30, 1995

[51] Int. Cl.[6] ..... F04B 49/06

[52] U.S. Cl. ..... 417/44.2; 417/415; 74/424.8 C

[58] Field of Search ..... 417/2, 44.2, 53, 417/415, 534, 536, 568, 362; 92/3, 31, 137, 138; 74/424.8 C

[56] References Cited

U.S. PATENT DOCUMENTS

| | | | |
|---|---|---|---|
| 4,397,610 | 8/1983 | Krohn | 417/44.2 |
| 5,004,403 | 4/1991 | Culbertson et al. | 417/53 |
| 5,491,633 | 2/1996 | Henry et al. | 74/424.8 C |

FOREIGN PATENT DOCUMENTS

| | | | |
|---|---|---|---|
| 0092864 | 4/1988 | Japan | 74/424.8 C |
| 0285362 | 11/1988 | Japan | 74/424.8 C |
| 002275982 | 9/1994 | United Kingdom | 74/424.8 C |

*Primary Examiner*—Timothy Thorpe
*Assistant Examiner*—Xuan M. Thai
*Attorney, Agent, or Firm*—Wallenstein & Wagner, Ltd.

[57] ABSTRACT

A pressure regulated electric pump is characterized by a positive displacement double acting reciprocating pump driven by an electric motor through a planetary roller screw. A controller senses the pressure of liquid at an outlet from the pump and varies the speed of the motor in a manner to maintain the pressure substantially constant. At a constant flow demand from the pump the motor is operated at a substantially constant speed. As flow demand rises and falls the instantaneous pump outlet pressure falls and rises. The changing pressure is sensed by the controller which makes incremental changes in the speed of the motor to cause the motor to speed up during a pressure fall and to slow down during a pressure rise, in such manner as to maintain pump outlet pressure substantially constant. Using a planetary roller screw to couple the electric motor rotary output to the pump provides a load torque on the motor that is directly proportional to pump outlet pressure plus frictional losses in the pump and drive mechanism. The result is a decrease in the magnitude of pressure drops and spikes in the pumped liquid at the time of changeover of the pump, i.e., at the time the direction of reciprocation of the pump changes.

12 Claims, 3 Drawing Sheets

PRESSURE REGULATED ELECTRIC PUMP

BACKGROUND OF THE INVENTION

The present invention relates to electrically driven pumps in general, and in particular to a pressure regulated electrically driven double acting reciprocating pump.

Circulation systems are often used to deliver a liquid coating material such as paint to coating stations for application onto articles to be coated. A paint circulation system customarily comprises a pump for the paint, motor means for operating the pump, and a paint flow line that extends from an outlet from the pump, past the various coating stations to which paint is to be delivered and back to an inlet to the pump. Each coating station is connected to the paint flow line for receiving paint upon demand by coating application equipment at the station, with any paint not provided to a coating station being circulated through the paint flow line and returned to the pump inlet, whereby paint not delivered to a coating station is circulated and maintained in motion so that pigments and fillers in the paint remain in suspension.

Since coating application equipment often has flow characteristics that are pressure dependent, for it to operate properly it usually is necessary that coating liquid or paint be delivered to it at a substantially constant pressure. A goal of paint circulation systems is therefore to provide paint at a constant pressure to the painting equipment, irrespective of the flow rate of paint demanded from the pump. The flow demand that the pump must meet has an absolute minimum that is based upon the minimum flow velocity required to keep paint pigments and fillers in suspension. As coating or paint stations go "on" or "off" the flow demand rises and falls at levels above the absolute minimum. Changes in flow demand tend to result in changes in pump outlet pressure.

Two types of supply pumps commonly used in paint circulating systems are turbine pumps which are kinetic pumps and reciprocating pumps which are positive displacement pumps. An advantage of a turbine pump is that it has a very flat pressure response over a wide range of flow rates, which enables the pump to provide a generally constant pressure paint flow under changing flow demands. This is particularly useful in painting systems where flow characteristics are pressure dependent, but there are two significant disadvantages of turbine pumps. One is that while a turbine pump is typically driven by an induction type motor having a relatively high efficiency in the 85% to 90% range, the efficiency of the pump itself is very low, usually on the order of 25% to 40%. The other disadvantage is that the constant "slip" of the liquid being pumped, against the walls of the impellers and bowls, degrades the pigments and fillers that are suspended in the paint. The worst case of paint degradation occurs when a turbine pump is running full speed with all painting stations "off". Turbine pumps are seldom speed controlled, so slip and churning of the paint are at a maximum when there is no demand for paint by the coating stations.

Positive displacement double acting reciprocating pumps utilize a piston to pump paint, and as compared to turbine pumps have the advantage of being nonaggressive to and causing minimal degradation to pigments and fillers in the paint, and of being able to attain higher operating efficiencies. In addition, unlike a turbine pump a reciprocating pump does not run at full speed all the time. Reciprocating pumps are driven by sources that operate under the principal of balancing forces caused by the driving pressure and the driven pressure, so they run at a minimum speed when all coating stations are "off" and speed up only as flow demands increase. Reciprocating pumps normally have relatively high efficiencies in the 85% to 90% range, but they can be and customarily are driven by reciprocating air or hydraulic mechanisms that have relatively low efficiencies on the order of about 20% and 60%, respectively. In addition to reducing the overall efficiency of the paint circulation system, there are other disadvantages to reciprocating air and hydraulic driving mechanisms. In the case of a reciprocating air driving mechanism, freezing problems can and do occur due to the rapid expansion of the exhausted air at changeovers, which occur at changes in direction of the reciprocating air driving mechanism. Air dryers can aid in reducing the freezing problem by taking moisture out of the air, but dryers can be a large capital expense and reduce overall system efficiency by requiring additional power. As for hydraulic driving mechanisms, they have the disadvantage of potentially serious oil contamination of the paint being pumped.

To avoid the disadvantages of air and hydraulic mechanisms for driving reciprocating pumps, electric motors have been used for the purpose, and a crank and connecting rod or a cam and cam follower have been utilized to convert the rotary output of the motor to the reciprocating motion of the pump. However, the effort has brought with it its own unique disadvantages, since both crank and connecting rod, and cam and cam follower, converting mechanisms result in a serious problem in maintaining a constant pump outlet pressure at changeover of the pump, i.e., during the time when the direction of reciprocation of the pump is reversed. As the reciprocating pump approaches changeover, both types of converting devices result in a rapidly decreasing load torque on the electric motor that allows the motor to rapidly speed up to account for the decreasing reciprocating velocity of the pump relative to the somewhat constant rotational speed of the motor. Also, at changeover the checks or check valves that control entry and exit of liquid to the pump reverse position, which has the effect of "catching" the rapidly rotating motor and severe shocks can result. Then, immediately after changeover the decreased load torque abruptly changes to rapidly increasing load torque that causes the electric motor to rapidly slow down. The net effect is a situation with difficult to control pressure drops and pressure spikes that respectively occur just before and just after changeover.

OBJECT OF THE INVENTION

An object of the invention is to provide a pressure regulated electrically driven positive displacement double acting reciprocating pump that is particularly adapted for use with a paint circulation system.

Another object is to provide such an electric pump that provides a substantially constant outlet pressure even at changeover of the pump.

A further object is to provide such an electric pump that utilizes a planetary roller screw to convert a rotary output from the electric motor to a reciprocating drive for the pump.

Yet another object is to provide such an electric pump in which pump outlet pressure is sensed and the speed of operation of the electric motor is controlled in accordance with the sensed pressure to maintain a substantially constant pump outlet pressure.

SUMMARY OF THE INVENTION

In accordance with the present invention, there is provided a pressure regulated electric pump for delivering at least a minimum volume flow rate of pumped liquid. The electric pump comprises a positive displacement double acting reciprocating pump having an outlet for delivering pumped liquid and an inlet for connection to a supply of liquid, means for sensing the pressure of pumped liquid, and an electric motor having a rotary output. A planetary roller screw assembly is coupled between the electric motor and the pump for converting the rotary output of the motor to a reciprocating output that operates the pump through pumping strokes and a controller means, that is responsive to the pressure sensing means, controls the direction and speed of rotation of the motor rotary output to operate the pump through pumping strokes at rates controlled to maintain a substantially constant pressure of pumped liquid despite changes in the volume flow rate of pumped liquid.

In a contemplated embodiment of the invention, the electric motor comprises an electric servomotor and the planetary roller screw assembly comprises a roller screw coupled to the motor rotary output for rotation in a direction and at a speed of rotation in accordance with the direction and speed of rotation of the motor rotary output, and a roller screw nut coupled to the pump and that is reciprocated by and along the roller screw in a direction and at a speed in accordance with the direction and speed of rotation of the roller screw, to conjointly reciprocate the pump through pumping strokes. The pump has a piston and a piston rod, and the roller screw nut is coupled to the pump piston rod for reciprocating the piston rod and piston through pumping strokes.

The foregoing and other objects, advantages and features of the invention will become apparent upon a consideration of the following detailed description, when taken in conjunction with the accompanying drawings.

DETAILED DESCRIPTION

In improving upon prior reciprocating pumps, particularly those used in paint circulation systems, the present invention uniquely couples the rotary output from an electric servomotor to a positive displacement double acting reciprocating pump through a planetary roller screw. This advantageously combines the high efficiencies of each of a reciprocating pump, an electric servomotor and a planetary roller screw to achieve a high system efficiency, while at the same time avoiding the disadvantages of rapid degradation of the pumped fluid as encountered with turbine pumps, problems associated with freezing in air drive systems, and the potential for fluid contamination in hydraulic drive systems.

Figure 1:
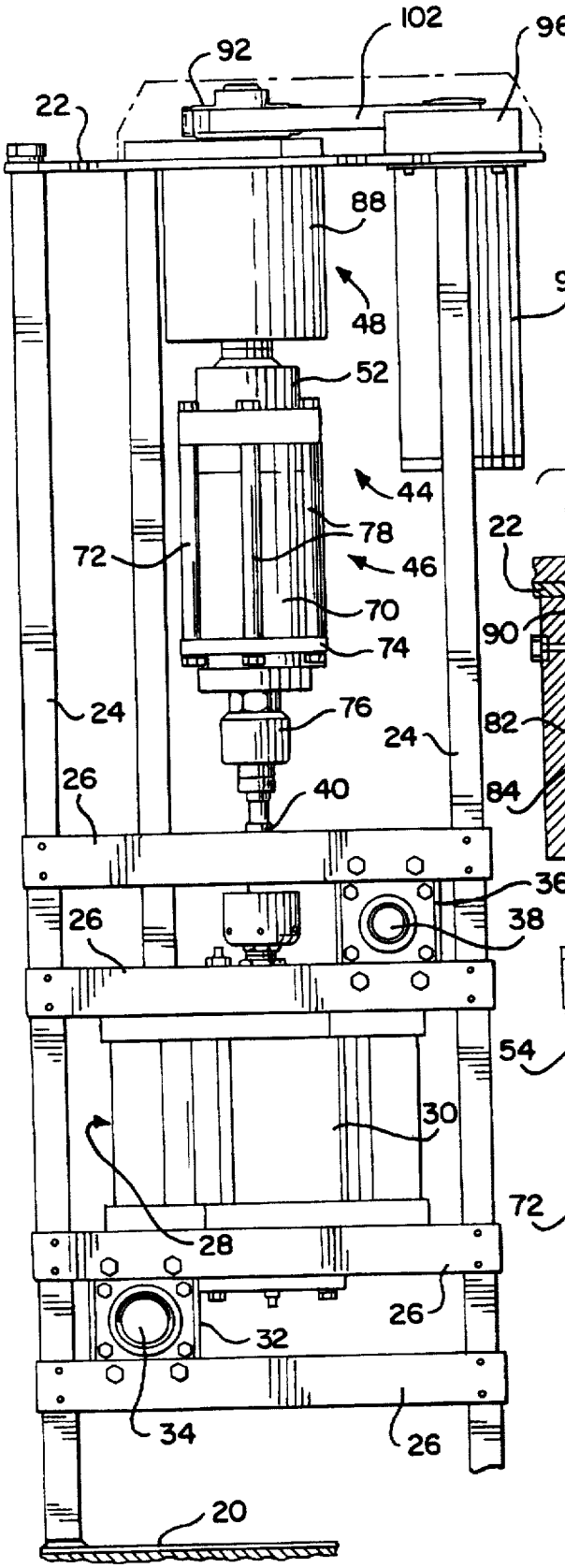
FIG. 1 is a front elevation view of a pressure regulated electric pump embodying the teachings of the invention.
Figure 2:
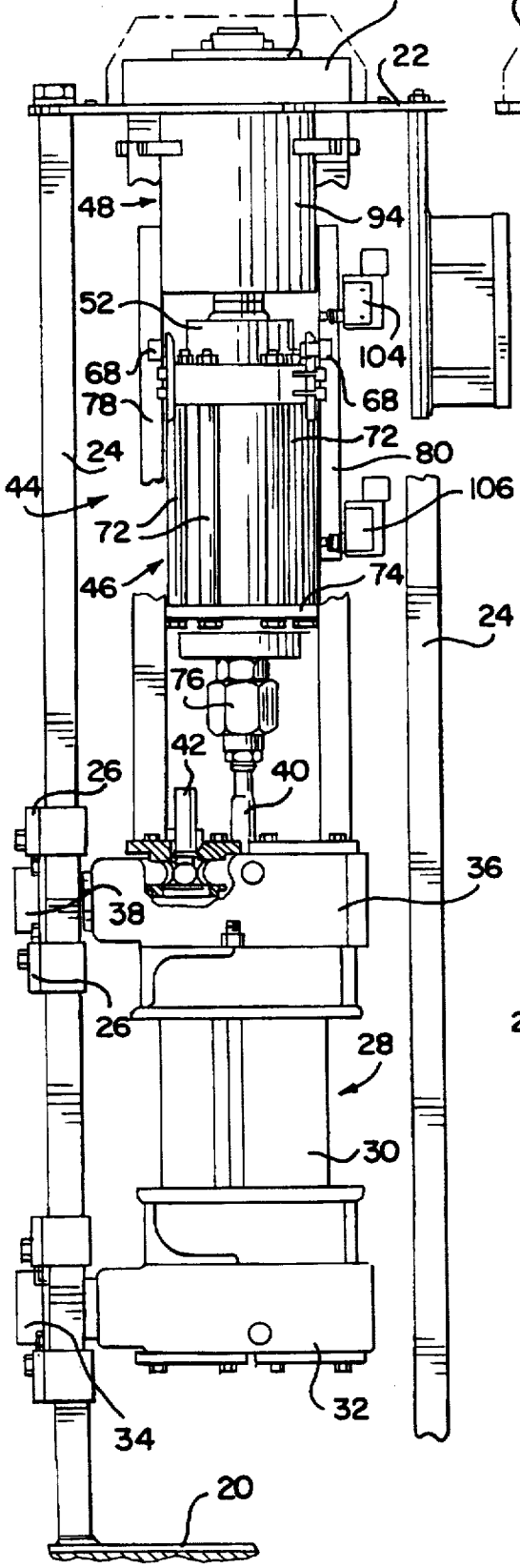
FIG. 2 is a side elevation view of the electric pump.
Figure 3:
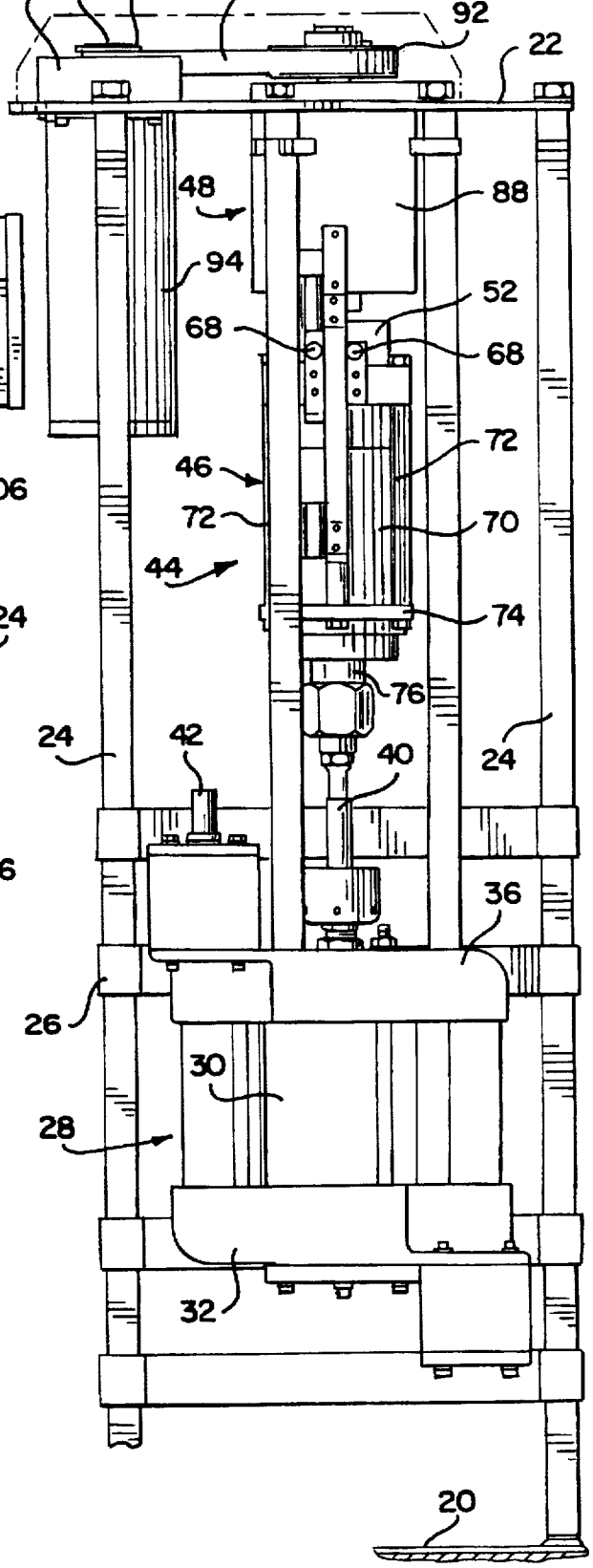
FIG. 3 is a rear elevation view of the electric pump.
Figure 4:
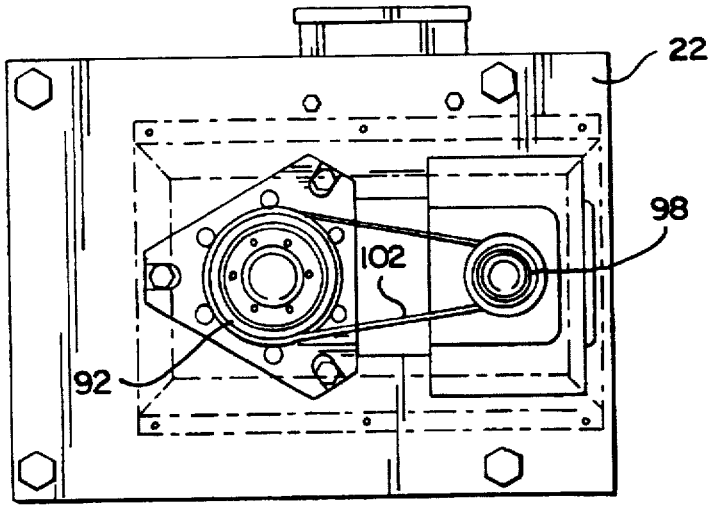
FIG. 4 is a top plan view of the electric pump.

Referring to FIGS. 1–3, a pressure regulated electric pump according to the teachings of the invention is supported on a platform that includes a bottom plate 20, a top plate 22, a plurality of legs 24 extending between the bottom and top plates and a plurality of supports 26 extending between the legs. The pumping mechanism consists of a positive displacement double acting reciprocating pump assembly, indicated generally at 28, carried by and toward a lower end of the platform. The pump assembly includes a pump body 30 within which a pump cylinder and a pump piston (neither shown) define pumping chambers to opposite sides of the piston in a manner understood by those skilled in the art. An inlet manifold assembly 32 at a lower end of the pump body has an inlet 34 and an outlet manifold assembly 36 at an upper end of the pump body has an outlet 38. Appropriate checks or check valves are provided in the inlet and outlet manifold assemblies, so that with each reciprocation of the pump piston in either direction a pumping stroke is executed. The pump piston is connected to and reciprocated by a pump piston rod 40.

For the vertical orientation of the pump as shown, upon upward movement of the piston, liquid is drawn through the inlet 34 into the inlet manifold assembly 32 and then into the pumping chamber on the lower side of the piston, while simultaneously liquid in the pumping chamber on the upper side of the piston is expelled from the pump through the outlet manifold assembly 36 and the outlet 38. Upon a subsequent downward stroke of the piston, liquid just previously drawn into the lower pumping chamber is expelled through the outlet 38, while simultaneously the upper pumping chamber is filled with liquid drawn through the inlet 34. A pressure transducer 42 on the outlet manifold assembly 36 senses the pressure of pumped liquid and generates a signal representative of the pressure.

Means for operating the reciprocating pump assembly 28 includes a carriage assembly, indicated generally at 44, coupled to an upper end of the pump piston rod 40 to reciprocate the piston rod and thereby the pump piston. The carriage assembly includes a planetary roller screw assembly indicated generally at 46 and a bearing assembly indicated generally at 48. The planetary roller screw assembly and the bearing assembly are supported by the top plate 22.

Figure 1A:
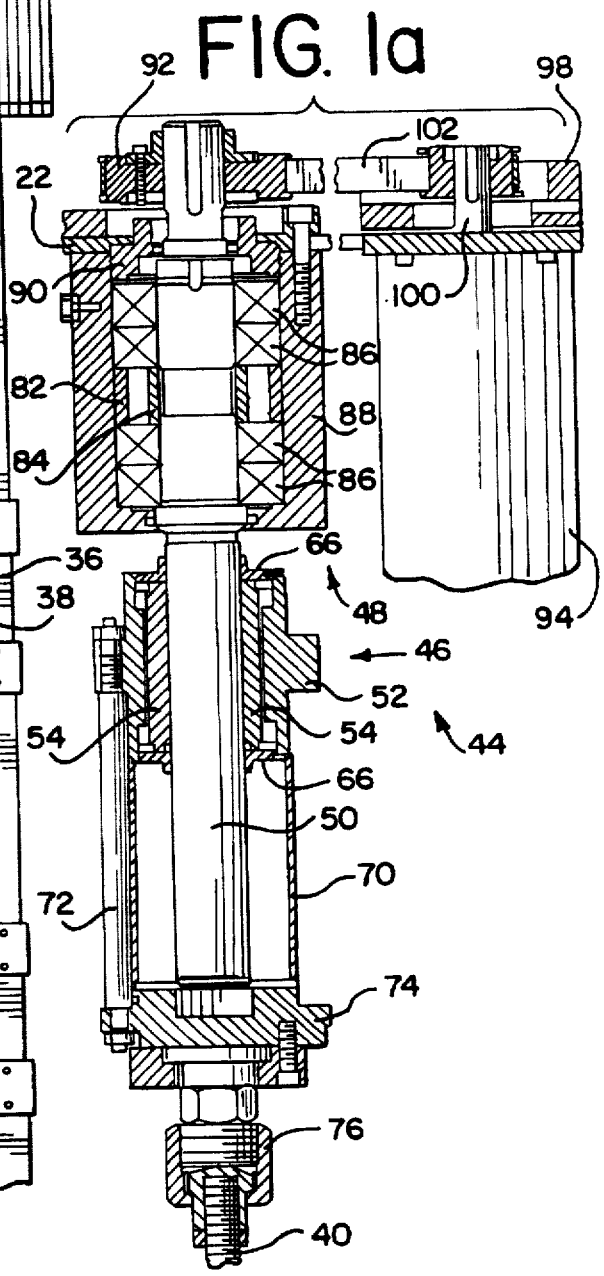
FIG. 1*a* is a cross sectional front elevation view of the upper portion of the pump, illustrating a bearing assembly and a planetary roller screw that are coupled between a rotary output from an electric motor and a piston rod of the pump for converting the rotary output from the motor to reciprocating motion for operating the pump.
Figure 5:
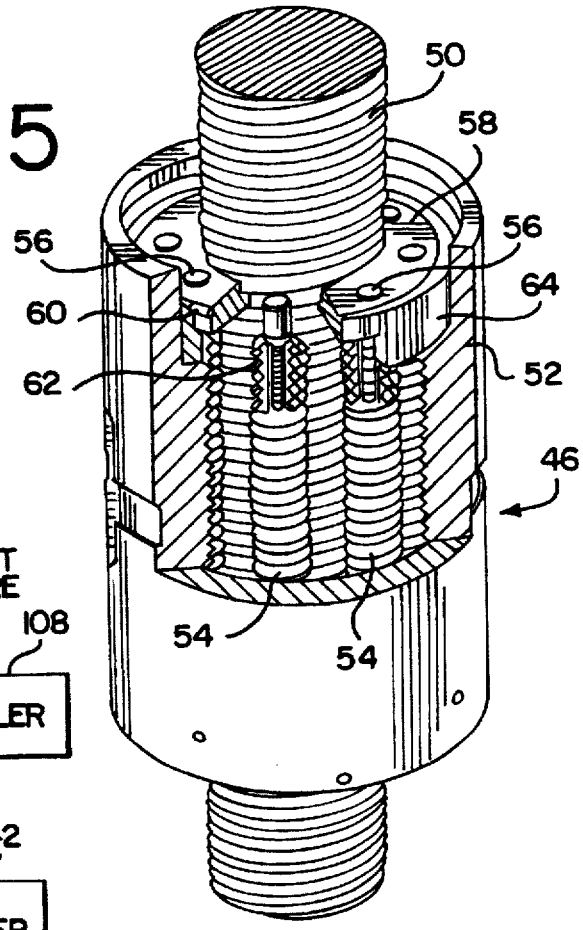
FIG. 5 is a perspective view, partially in cross section, of a planetary roller screw that may be used with the electric pump.

FIGS. 1*a* and 5 best show the planetary roller screw assembly 46, which includes a roller screw 50 that has a triangular thread with an included angle of 90°. A roller screw nut 52 is threaded internally with the same type and number of threads as is the roller screw 50. A plurality of rollers 54, threaded with a single start triangular thread having an included angle of 90°, roll between the roller screw nut and the roller screw. The thread form is barrelled to give a large contact radius for high load carrying capacity and high rigidity. The helix angle of the thread of the rollers 54 is identical to the thread of the roller screw nut 52, so that the rollers do not move axially as they roll inside the roller screw nut. Spigots 56 at opposite ends of each roller 54 are received in associated openings spaced around and through guide rings 58 (only one shown) at opposite ends of the roller screw nut 52 and keep the rollers equally spaced around the periphery of the roller screw nut. The guide rings 58, each of which is kept in position by an associated spring ring 60, are not loaded. To ensure correct rolling motion of the rollers 54, relative to the screw nut 52, opposite ends of each roller define gear teeth 62 that mesh at each end with an associated internally toothed ring 64 (only one shown). A wiper 66 is at each end of the planetary roller screw. The planetary roller screw assembly 46 as shown in FIG. 5 is known in the art and sold by SKF Group as model no. SR/TR/PR.

A planetary roller screw consists, in general, of a roller screw and a roller screw nut that moves back and forth along on the roller screw, depending upon the direction in which the roller screw is rotated. The device is somewhat similar to a ball screw (not shown) only in the sense that, in general, it includes a screw rod and a nut device. A ball screw consists of a screw rod with balls that run in the grooves of the screw rod while recirculating within a nut. Each ball has a point of contact within the groove of the screw rod. The balls rolling within the nut are similar to the balls in a bearing, and acceleration is limited to about 0.3 G due to slippage of the balls that occurs at higher accelerations and that causes galling of the grooves in the screw rod. Also, even though there are many balls of a ball screw supporting a load at any one time, the point contact of each ball with the groove of the screw rod does not support the load economically as far as space and size are concerned, which requires the screw rod size and nut size to be large relative to the load carried. As a result, while there are some general similarities between a ball screw and a planetary roller screw, use of a ball screw in place of the planetary roller screw to operate the pump assembly 28 would require a ball screw of such large size as to make the overall pump assembly of the invention impractical for use in high volume and moderate but constant pressure circulating paint systems, since the size of the screw rod that would be required to support the reciprocating load would be so large that the inertia of the screw rod would make it difficult, if not impossible, to control the speed of operation of the pump as flow demand changes and at changeovers, in such manner as to maintain a substantial constant pump outlet pressure. However, in common with a planetary roller screw, a ball screw device does not have a problem of exhibiting a changing torque load at any point of the pump piston stroke due to the relative reciprocating motion of the pump to the rotating motion of the motor, since the load torque on the motor is directly proportional to pressure and any frictional loses in the pump and drive mechanism.

As compared to a ball screw, the planetary roller screw 46 has the set of rollers 54 that have the same pitch thread as does the roller screw, and axes that are parallel to the axis of the roller screw. Each roller has a line of contact with the groove in the roller screw, which allows for much greater loads for a given roller screw diameter than could be accommodated by a ball screw, thereby giving the planetary roller screw a much reduced mass and inertia, as compared to a ball screw, for a specified load rating. The rollers of the planetary roller screw also are linked to a planetary gear that forces their rolling within the roller screw nut 52 to eliminate or nearly eliminate the chance for slippage and galling. Accelerations up to 3.0 G can therefore be realized with a planetary roller screw.

The carriage assembly 44 is connected to the piston rod 40 of the reciprocating pump assembly 28 to reciprocate the piston rod and thereby the pump piston, and includes the planetary roller screw nut 52 of the planetary roller screw assembly 46, a plurality of cam followers 68, a heatsink/oil bath contained within a lower end cover 70, a plurality of struts 72 connecting the roller screw nut 52 to a carriage plate 74, and a pump rod mounting swivel 76 that couples the carriage plate to the upper end of the pump piston rod. Vertical reciprocating movement of the planetary roller screw assembly roller screw nut 52, as a result of rotation of the roller screw 50, is imparted by the struts 72 to the carriage plate 74 to reciprocate the pump piston rod via the pump rod mounting swivel 76.

The roller screw nut 52 of the planetary roller screw assembly 46 moves vertically with rotation of the roller screw 50, although the roller screw nut is restricted from rotating by means of the cam followers 68 that are coupled to the roller screw nut and trap stationary runners 78 and 80 between them. The bearing assembly 48, through which the roller screw 50 extends, includes bearing spacers comprising an outer race 82 and an inner race 84, along with quadrature angular contact bearings 86. The inner and outer races 82 and 84 and the quadrature bearings 86 are in a bearing housing 88 that mounts to the platform top plate 22. The planetary roller screw assembly is retained in the bearing housing 88 by clamping the outer races of the quadrature bearings within the bearing housing by means of an outer race nut 90. The stationary runners 78 and 80, between which the cam followers 68 are received, mount to the bearing housing 88.

Above the top plate 22, a synchronous drive sprocket or roller screw pulley 92 is attached to the upper end of the roller screw 50. An electric servomotor 94 is connected to the top plate by means of a motor heatsink 96. A synchronous drive sprocket or motor pulley 98 is attached to an output shaft 100 of the motor. The motor pulley 98 and the roller screw pulley 92 are connected by a synchronous drive belt 102. An upper limit switch 104 and a lower limit switch 106 are carried by the stationary runner 80 and are used, as will be described, by a control program upon every start up of the pump assembly.

Upon operation of the electric servomotor 94 to cause its output shaft 100 to rotate in one direction, the output from the motor is coupled via the motor pulley 98, the synchronous drive belt 102 and the roller screw pulley 92 to the roller screw 50 to rotate the roller screw in the one direction and thereby move or reciprocate the roller screw nut 52 in a first direction along the roller screw to cause the pump piston rod 40, and thereby the pump piston, to reciprocate in the first direction at a speed in accordance with the speed of operation of the motor. Upon operation of the electric motor to cause its output shaft to rotate in the opposite direction, the roller screw nut and thereby the pump piston rod and the pump piston are reciprocated in a second and opposite direction at a speed in accordance with the speed of operation of the motor. Thus, by controlling the direction and speed of operation of the electric motor 94, the double acting reciprocating pump assembly 28 may be operated through its pumping strokes at selected and controlled rates.

Figure 6:
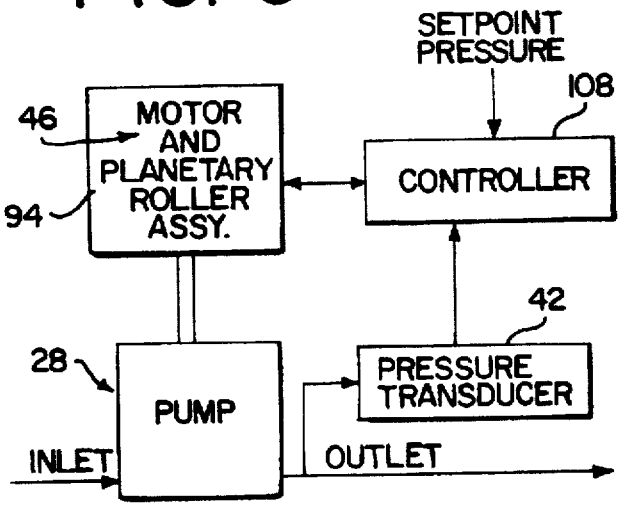
FIG. 6 is a simplified block diagram representation of the pressure regulated electric pump system.

With reference also to FIG. 6, the pressure regulated electric pump of the invention includes the pressure transducer 42, which is responsive to or senses the liquid pressure developed by the pump 28 at its outlet and provides a signal representative of the pressure to a controller 108. The controller includes a CPU or microprocessor that performs a control program and is responsive to the signal from the pressure transducer to control the speed of the motor 94 in a manner to maintain a substantially constant operator selected pressure at the outlet from the pump. At a constant flow demand or flow rate of liquid from the pump, the electric motor 94 generally runs at a constant speed during each stroke of the pump. As flow demand rises and falls, the instantaneous pressure at the pump outlet falls and rises. The changing pressure is sensed by the pressure transducer 42, the signal from which is monitored by the controller. The controller then operates the motor, in accordance with the control program, in a manner to make incremental changes in the speed of operation of the motor to cause the motor to speed up during a pressure fall and to slow down during a pressure rise. So that the response time of the system will be sufficiently fast to make seemingly instantaneous responses to small pressure changes, to thereby maintain a substantially constant pressure at the pump outlet, the control program advantageously cycles through a pressure sampling loop in 300 ms or less.

In a contemplated operation of the invention, the control program initializes itself by starting the electric motor 94 at a relatively slow speed. The control program then samples or senses pump outlet pressure, as indicated by the signal from the transducer 42 at the slow motor speed. If the sensed pressure is less than a setpoint pressure as determined and set by an operator, then the controller incrementally speeds up the motor until the sensed and setpoint pressures are equal, and the pressure equalizing motor speed is set as a setpoint speed. The set speed is then fed into a main control loop that samples pump outlet pressure within the 300 ms sampling loop limit. As long as the sampled pump outlet pressure is the same as the setpoint pressure, the commanded speed of the motor is set equal to the setpoint speed. As small pressure fluctuations occur and are sensed within a setable bandwidth, new commanded motor speeds are calculated by adding a factor to the setpoint speed. The factor is calculated by subtracting the sampled pump outlet pressure from the setpoint pressure and multiplying the difference by a gain. If the sampled pressure is outside of the setable bandwidth, the control loop goes to another control loop that resets the setpoint motor speed in the manner described and then returns to the main control loop.

As a preliminary step in initialization of the control program, the control program first operates the motor slowly, until the carriage assembly rises high enough to trip the upper limit switch 104, whereupon the direction of operation of the motor is reversed until the lower limit switch 106 is tripped. The control program then calculates the distance of travel of the roller screw nut 52 of the planetary roller screw assembly 46 between the upper and lower limit switches and sets the operating travel of the roller screw nut to be within, but not to, the upper and lower limits. The control program then allows the reciprocating pump assembly 28 to be operated by the electric motor 94 within the calculated or acceptable travel limits, in the manner described, except for the ends of the travel where changeover occurs. Just before changeover, the motor is operated in a manner to cause the motor to go substantially immediately to zero velocity, e.g., by momentarily energizing the motor for rotation in the opposite direction. Immediately upon reaching zero velocity, the motor is operated by the controller to return to the last motor setpoint speed before changeover but in the opposite direction, except that at this point the last motor setpoint speed is momentarily increased by multiplying it by a setable factor to cause the pressure developed at the pump outlet to more quickly reach the last setpoint pressure. This increased motor setpoint speed is commanded by the controller for a setable time duration that is typically under 200 ms, and the setable factor is typically in the range of 1.0 to 1.5 and is used to account for the pressure drop during changeover. After operating the motor at the increased motor setpoint speed, control of the motor is passed back to the main control loop and the motor setpoint speed is returned to the last actual value it was just before changeover. The particular operation of the motor and pump at the time of changeover significantly decreases the time for which pump outlet pressure is less than the setpoint pressure, which in turn significantly decreases the magnitude of pressure drops and spikes of the pumped liquid at the time of changeover. It is to be appreciated that significantly contributing to the decreased time for which the pressure of pumped liquid is less than the setpoint pressure is the planetary roller screw assembly 46, the inertia of which is relatively low and the torque response of which is substantially linear and directly related to pump outlet pressure to accommodate rapid and generally linear changes in motor setpoint speeds.

While one embodiment of the invention has been described in detail, various modifications and other embodiments thereof may be devised by one skilled in the art without departing from the spirit and scope of the invention, as defined in the appended claims.

What is claimed is:

1. A pressure regulated electric pump for delivering at least a minimum volume flow rate of pumped liquid, comprising:

a positive displacement double acting reciprocating pump having an outlet for delivering pumped liquid and an inlet for connection to a supply of liquid;

means for sensing the pressure of pumped liquid;

an electric motor having a rotary output;

a planetary roller screw assembly coupled between said electric motor rotary output and said pump for converting said rotary output of said motor to a reciprocating output that reciprocates said pump through pumping strokes; and controller means responsive to said pressure sensing means for controlling the direction and speed of rotation of said motor rotary output to operate said pump through pumping strokes at rates controlled to maintain a substantially constant pressure of pumped liquid despite changes in the volume flow rate of pumped liquid.

2. A pressure regulated electric pump as in claim 1, wherein said electric motor comprises an electric servomotor.

3. A pressure regulated electric pump as in claim 1, wherein said planetary roller screw assembly comprises a roller screw coupled to said motor rotary output for rotation in a direction and at a speed of rotation in accordance with the direction and speed of rotation of said motor rotary output, and a roller screw nut coupled to said pump and that is reciprocated by and along said roller screw in a direction and at a speed in accordance with the direction and speed of rotation of said roller screw to conjointly reciprocate said pump through pumping strokes.

4. A pressure regulated electric pump as in claim 1, wherein said pump has a piston and a piston rod, and said planetary roller screw assembly is coupled to said pump piston rod for reciprocating said piston rod and piston through pumping strokes.

5. A pressure regulated electric pump as in claim 1, wherein said pressure sensing means comprises pressure transducer means for sensing the pressure of pumped liquid at said pump outlet.

6. A pressure regulated electric pump as in claim 1, wherein said planetary roller screw assembly includes a roller screw coupled to said motor rotary output and a roller screw nut coupled to said pump to reciprocate said pump through pumping strokes, and including synchronous timing means for coupling said motor rotary output to said roller screw to rotate said roller screw in a direction and at a speed of rotation in accordance with the direction and speed of rotation of said motor rotary output, and further including bearing means for supporting said roller screw for rotation.

7. A pressure regulated electric pump for delivering at least a minimum volume flow rate of pumped liquid, comprising:

a positive displacement double acting reciprocating pump having an outlet for delivering pumped liquid and an inlet for connection to a supply of liquid;

means for sensing the pressure of pumped liquid;

a planetary roller screw assembly having a roller screw and a roller screw nut that is reciprocated by and along said roller screw in a direction and at a speed in accordance with the direction and speed of rotation of said roller screw;

means for coupling said roller screw nut to said pump to reciprocate said pump, conjointly with said roller screw nut, through pumping strokes in a direction and at a rate in accordance with the direction and speed of rotation of said roller screw; and electric motor means responsive to said pressure sensing means for rotating said roller screw alternately in opposite directions at speeds of rotation in accordance with the sensed pressure of pumped liquid to reciprocate said pump through pumping strokes at rates that maintain a substantially constant pressure of pumped liquid despite variations in the volume flow rate of pumped liquid.

8. A pressure regulated electric pump as in claim 7, including means for selecting the value of the constant pressure of pumped liquid.

9. A pressure regulated electric pump as in claim 7, wherein as the volume flow rate of pumped liquid rises and falls the instantaneous pressure of pumped liquid falls and rises, and wherein in response to a sensed decrease in pressure said electric motor means increases the speed of rotation of said roller screw to increase the rate of said pumping strokes of said pump, and in response to a sensed increase in pressure said electric motor means decreases the speed of rotation of said roller screw to decrease the rate of said pumping strokes of said pump, to maintain said substantially constant pressure of pumped liquid.

10. A pressure regulated electric pump as in claim 7, wherein said pump has a piston and a piston rod, and said roller screw nut is coupled to said piston rod for reciprocating said piston rod and piston through pumping strokes.

11. A pressure regulated electric pump as in claim 7, wherein said electric motor means comprises an electric servomotor having a rotary output coupled to said roller screw to rotate said roller screw in a direction and at a speed of rotation in accordance with the direction and speed of rotation of said motor rotary output, and controller means responsive to said pressure sensing means for controlling the direction and speed of rotation of said motor means rotary output in accordance with the sensed pressure of pumped liquid to maintain said substantially constant pressure of pumped liquid.

12. A pressure regulated electric pump as in claim 11, wherein as flow demand from said pump rises and falls the instantaneous pressure of pumped liquid respectively falls and rises, and wherein said controller means, in response to a sensed change in the pressure of pumped liquid from said substantially constant pressure, incrementally changes the speed of operation of said motor means to cause said motor means rotary output to speed up during a pressure fall and to slow down during a pressure rise to maintain said substantially constant pressure.

* * * * *